US007245277B2

(12) United States Patent
Ishizuka

(10) Patent No.: US 7,245,277 B2
(45) Date of Patent: Jul. 17, 2007

(54) DISPLAY PANEL AND DISPLAY DEVICE

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 354 days.

(21) Appl. No.: 10/615,396

(22) Filed: Jul. 9, 2003

(65) Prior Publication Data

US 2004/0051684 A1 Mar. 18, 2004

(30) Foreign Application Priority Data

Jul. 10, 2002 (JP) ..... 2002-201696

(51) Int. Cl.
*G09G 3/30* (2006.01)
*G09G 3/32* (2006.01)
*G09G 3/10* (2006.01)

(52) U.S. Cl. ..... 345/78; 345/82; 315/169.3

(58) Field of Classification Search ..... 345/76; 315/169.3

See application file for complete search history.

(56) References Cited

U.S. PATENT DOCUMENTS

| | | | | |
|---|---|---|---|---|
| 5,594,463 | A | 1/1997 | Sakamoto | |
| 5,949,194 | A | 9/1999 | Kawakami et al. | |
| 6,356,029 | B1 | 3/2002 | Hunter | |
| 6,404,139 | B1 * | 6/2002 | Sasaki et al. | 315/169.3 |
| 6,429,600 | B1 * | 8/2002 | Fujita et al. | 315/169.3 |
| 6,479,940 | B1 * | 11/2002 | Ishizuka | 315/169.3 |
| 6,518,962 | B2 * | 2/2003 | Kimura et al. | 345/211 |
| 2001/0013758 | A1 * | 8/2001 | Tsuruoka et al. | 315/169.3 |
| 2002/0125831 | A1 * | 9/2002 | Inukai et al. | 315/169.3 |
| 2002/0130625 | A1 * | 9/2002 | Palmer et al. | 315/169.3 |
| 2003/0011314 | A1 * | 1/2003 | Numao | 315/169.3 |

FOREIGN PATENT DOCUMENTS

| | | |
|---|---|---|
| EP | 0 923 067 A1 | 6/1999 |
| EP | 1 005 013 A1 | 5/2000 |
| EP | 1 282 101 A1 | 2/2003 |

* cited by examiner

*Primary Examiner*—Richard Hjerpe
*Assistant Examiner*—M. Fatahiyar
(74) *Attorney, Agent, or Firm*—Sughrue Mion, PLLC

(57) ABSTRACT

An active type display panel comprises a plurality of pixel sections each having a series circuit constituted by a light emitting element and a drive element for supplying a drive current to the light emitting element, a pair of power supply lines which connect the series circuits of the pixel sections in parallel, and a plurality of measurement lines. Each of the pixel sections includes a switch element between a point connecting the light emitting element and the drive element, and one line of the measurement lines. A display device, in which the display panel is used, detects the voltage across the terminals of the light emitting element and controls the drive element such that the voltage across these terminals is a predetermined voltage.

9 Claims, 10 Drawing Sheets

DISPLAY PANEL AND DISPLAY DEVICE

BACKGROUND OF THE INVENTION

1. Field of the Invention

The present invention relates to an active type display panel in which light emitting elements such as organic electroluminescence elements are disposed, a display device in which the display panel is used, and a display panel driving method thereof.

2. Description of the Related Art

Electroluminescence display devices (referred to as EL display devices hereinafter) mounted with a display panel employing organic electroluminescence elements (referred to simply as EL elements hereinafter) in the form of light emitting elements carrying pixels are currently attracting attention. Known systems for driving display panels by means of these EL display devices include simple matrix type and active matrix type systems. In comparison with simple matrix type systems, active matrix type EL display devices consume very little electrical power and afford advantages such as low cross-talk between pixels, and are particularly suitable as large screen display devices and high definition display devices, and so forth.

As shown in FIG. 1, EL display devices are constituted by a display panel 1, and a driving device 2 for driving the display panel 1 in accordance with an image signal.

The display panel 1 is formed having an anode power supply line 3, a cathode power supply line 4, m data lines (data electrodes) A1 to Am arranged in parallel so as to extend in the perpendicular (vertical) direction of one screen, and n horizontal scan lines (scan electrodes) B1 to Bn for one screen which are orthogonal to the data lines A1 to Am. A drive voltage Vc is applied to the anode power supply line 3 and a ground potential GND is applied to the cathode power supply line 4. Further, pixel sections $E_{1.1}$ to $E_{m.n}$ each carrying one pixel are formed at the points of intersection between the data lines A1 to Am and the scan lines B1 to Bn of the display panel 1.

The pixel sections $E_{1.1}$ to $E_{m.n}$ have the same constitution and are constituted as shown in FIG. 2. That is, the scan line B is connected to the gate G of a scan line selection FET (Field Effect Transistors) 11, and the data line A is connected to the drain D thereof. The gate G of a FET 12, which is a light emission drive transistor, is connected to the source S of the FET 11. When the drive voltage Vc is applied via the anode power supply line 3 to the source S of the FET 12, a capacitor 13 is connected between this gate G and source S. In addition, the anode terminal of the EL element 15 is connected to the drain D of the FET 12. A ground potential GND is applied through the cathode power supply line 4 to the cathode terminal of the EL element 15.

The driving device 2 applies a scan pulse sequentially and alternatively to the scan lines B1 to Bn of the display panel 1. In addition, the driving device 2 generates, in sync with the application timing of the scan pulse, pixel data pulses $DP_1$ to DPm which are dependent on the input image signals corresponding to the horizontal scan lines, and applies these pulses to the data lines A1 to Am respectively. The pixel data pulses DP each have a pulse voltage which is dependent on the luminance level indicated by the corresponding input image signal. The pixel sections which are connected on the scan line B to which the scan pulse is applied are the write targets of this pixel data. The FET 11 in a pixel section E which is the write target of this pixel data assumes an on state in accordance with the scan pulse such that the pixel data pulse DP supplied via the data line A is applied to the gate G and to the capacitor 13 of the FET 12. The FET 12 generates a light emission drive current which is dependent on the pulse voltage of this pixel data pulse DP and supplies this drive current to the EL element 15. In response to this light emission drive current, the EL element 15 emits light at a luminance which is dependent on the pulse voltage of the pixel data pulse DP. Meanwhile, the capacitor 13 is charged by the pulse voltage of the pixel data pulse DP. As a result of this recharging operation, a voltage that depends on the luminance level indicated by the input image signal is stored in the capacitor 13 and so-called pixel data writing is then executed. Here, when discharge from the pixel data write target takes place, the FET 11 enters an off state, and the supply of the pixel data pulse DP to the gate G of the FET 12 is halted. However, because the voltage stored in the capacitor 13 as described above is continuously applied to the gate G of the FET 12, the FET 12 continues to cause a light emission drive current to flow to the EL element 15.

The light emission luminance of the EL elements 15 of each of the pixel sections $E_{1.1}$ to $E_{m.n}$ depends on the voltage which is stored in the capacitor 13 as described above according to the pulse voltage of the pixel data pulse DP. In other words, the voltage stored in the capacitor 13 is the gate voltage of the FET 12 and therefore the FET 12 causes a drive current (drain current Id) that is dependent on the gate-source voltage Vgs to flow to the EL element 15. The relationship between the gate-source voltage Vgs of the FET 12 and the drain current Id is as shown in FIG. 3, for example. The flow of drive current through the EL element 15, which current is at a level that is dependent on the level of the voltage stored in the capacitor 13, constitutes the light emission luminance that depends on the level of the voltage stored in the capacitor 13. Thus, the EL display device is capable of a gray level display.

In a drive transistor such as the FET 12, the characteristic for the relationship between the gate-source voltage Vgs and the drain current Id changes according to temperature changes and inconsistencies in the transistor itself. For example, in cases where characteristics (characteristics indicated by solid lines) deviate from the standard characteristic (broken line) as shown in FIG. 4, the respective drain currents Id are different for the same gate-source voltage Vgs, and therefore the EL element cannot be caused to emit light at the desired luminance.

A voltage change range for the gate-source voltage Vgs with respect to the luminance change range which is required for the gray level display is established beforehand. If the characteristic for the relationship between the gate-source voltage Vgs and the drain current Id is standard, the current change range of the drain current Id with respect to the voltage change range of the gate-source voltage Vgs is as shown in FIG. 5A. The current change range of the drain current Id shown in FIG. 5A is a range that corresponds to the luminance change range required for the gray level display. On the other hand, in cases where there is a change in the relationship characteristic, the current change range of the drain current Id with respect to the pre-established voltage change range of the gate-source voltage Vgs differs from the luminance change range required for the gray level display shown in FIG. 5A, as shown in FIGS. 5B and 5C. Therefore, when there is a variation in the drive current characteristic with respect to the input control voltage as a result of a drive transistor temperature variation and inconsistencies in the transistor itself, a correct gray level display is not possible.

SUMMARY OF THE INVENTION

Accordingly, an object of the present invention is to provide an active type display panel in which light emitting elements such as organic electroluminescence elements are disposed in the form of a matrix and which is capable of implementing a correct gray level display even when used for a long period, and to provide a display device that employs the display panel and a driving method for the display panel.

A display panel according to the present invention comprises a plurality of pixel sections each including a series circuit in which a light emitting element and a drive element which supplies a drive current to said light emitting element are connected in series, a pair of power supply lines which connect the series circuits of the plurality of pixel sections in parallel, and a plurality of measurement lines; wherein each of the plurality of pixel sections includes a switch element which is provided between a point connecting the light emitting element and the drive element, and one measurement line of the plurality of measurement lines.

A display device according to the present invention comprises: an active type display panel comprising a plurality of data lines, a plurality of scan lines mutually intersecting the plurality of data lines, and a plurality of pixel sections each including a series circuit in which a light emitting element and a drive element which supplies a drive current to the light emitting element are connected in series, and which is connected between one of the plurality of data lines and one of the plurality of scan lines at an intersection thereof; a power voltage supply portion which applies a power voltage to the series circuit of each of the pixel sections; and a display controller which designates one scan line of the plurality of scan lines sequentially with predetermined timing in accordance with an input image signal, supplies a scan pulse to the designated one scan line, and supplies a data signal indicating light emission luminance to at least one data line of the plurality of data lines in a scanning period during which the scan pulse is supplied, the at least one data line corresponding to at least one light emitting element to be emitted light on the designated one scan line, wherein each of the pixel sections includes a pixel controller which activates the drive element in accordance with the data signal to supply a drive current of a level corresponding to the data signal to the light emitting element, and a voltage detector which detects a voltage across the terminals of the light emitting element; and the display controller includes a data correction portion which corrects the data signal such that the voltage across the terminals of the light emitting element becomes equal to a predetermined voltage for each of the plurality of data lines.

A display panel driving method according to the present invention is a method for driving an active type display panel comprising a plurality of data lines, a plurality of scan lines mutually intersecting the plurality of data lines, and a plurality of pixel sections each including a series circuit in which a light emitting element and a drive element for supplying a drive current to the light emitting element are connected in series, and which is connected between one of the plurality of data lines and one of the plurality of scan lines at an intersection thereof; comprising the steps of: applying a power voltage to the series circuit of each of the pixel sections; designating one scan line of the plurality of scan lines sequentially with predetermined timing in accordance with an input image signal, supplying a scan pulse to the designated one scan line, and supplying a data signal indicating light emission luminance to at least one data line of the plurality of data lines in a scanning period during which the scan pulse is supplied, the at least one data line corresponding to at least one light emitting element to be emitted light on the designated one scan line; in each of the pixel sections, activating the drive element in accordance with the data signal to supply a drive current of a level corresponding to the data signal to the light emitting element, and detecting a voltage across the terminals of the light emitting element; and correcting the data signal such that the voltage across the terminals of the light emitting element becomes equal to a predetermined voltage for each of the plurality of data lines.

DETAILED DESCRIPTION OF THE INVENTION

The present invention will be described below in more detail with reference to the accompanying drawings in accordance with the embodiments.

Figure 1:
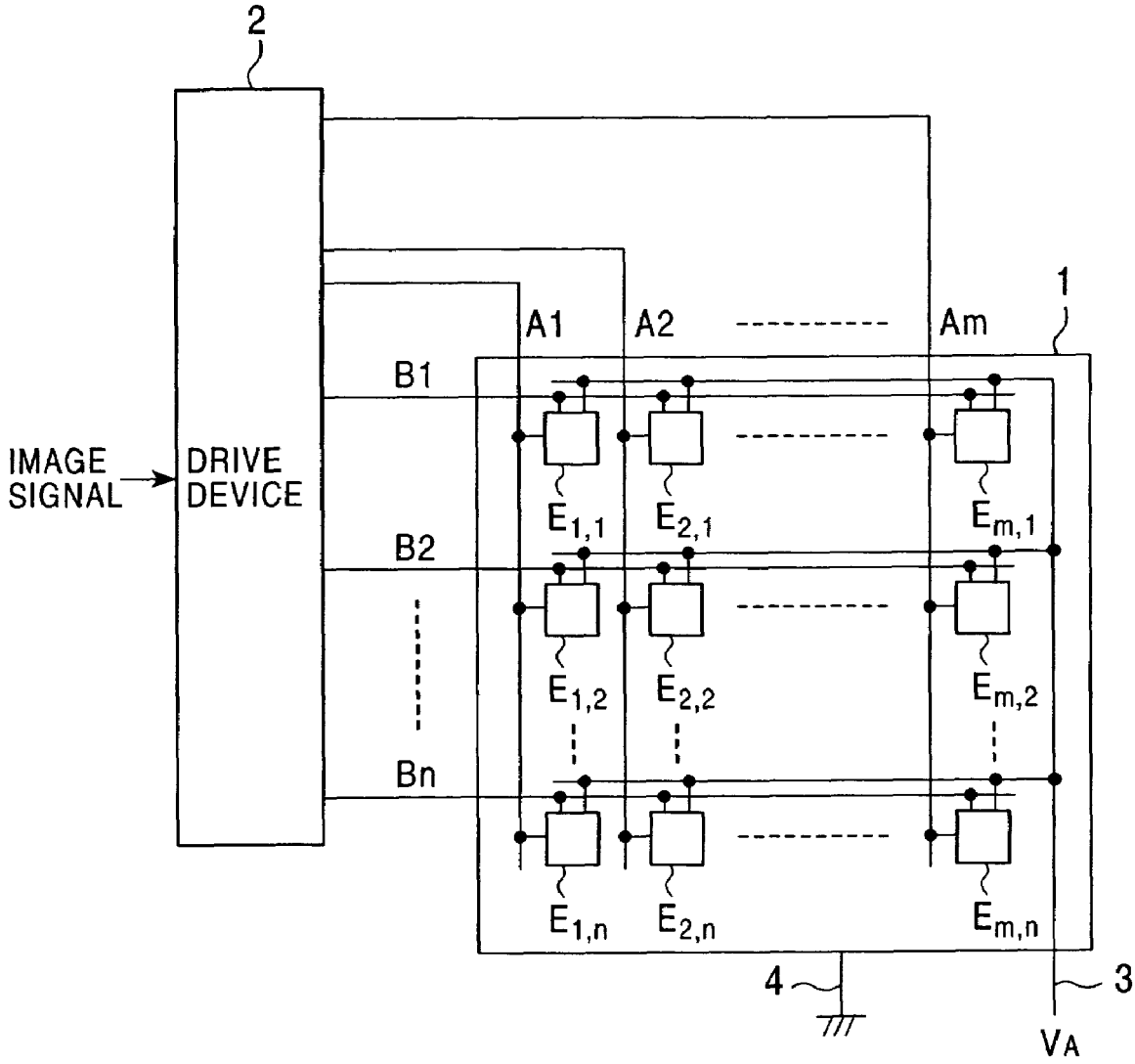
FIG. 1 is a block diagram showing the constitution of a conventional EL display device.
Figure 2:
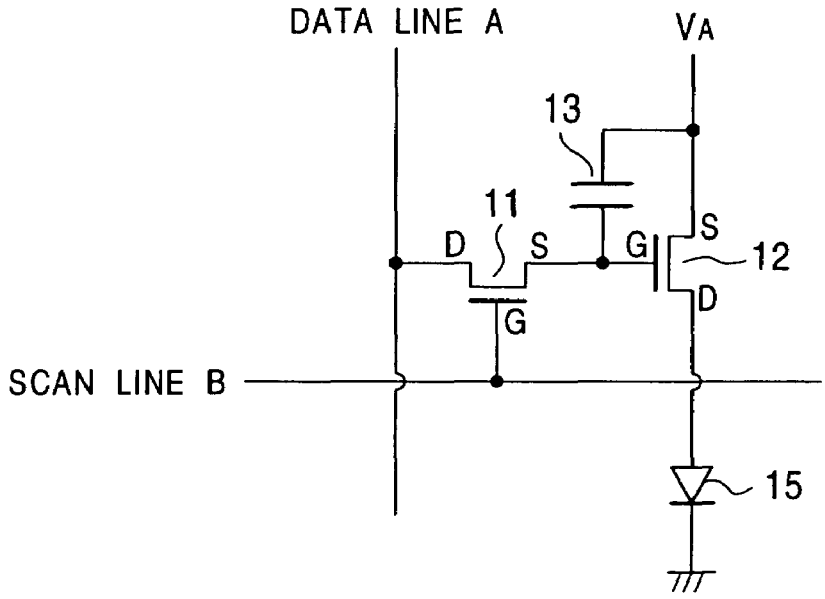
FIG. 2 is a circuit diagram showing the constitution of a pixel section in FIG. 1.
Figure 3:
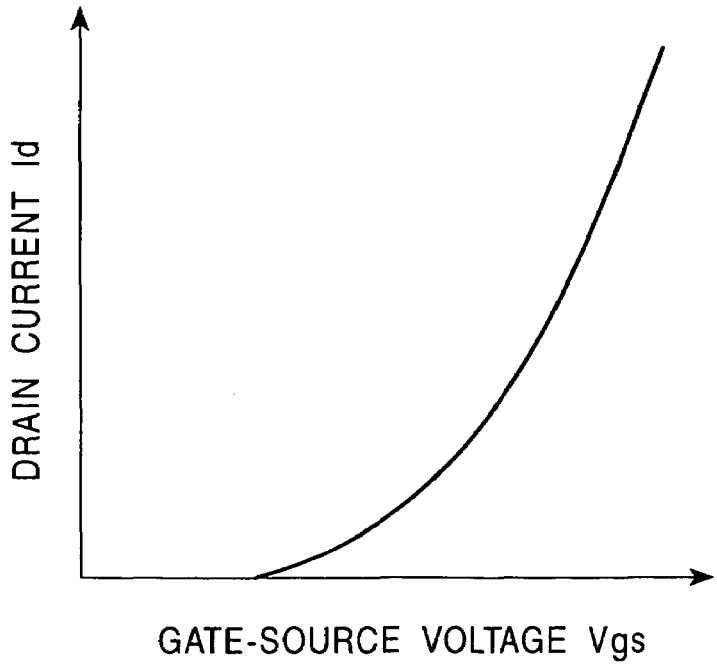
FIG. 3 shows the gate-source voltage/drain current characteristic of an FET in a pixel section.
Figure 4:
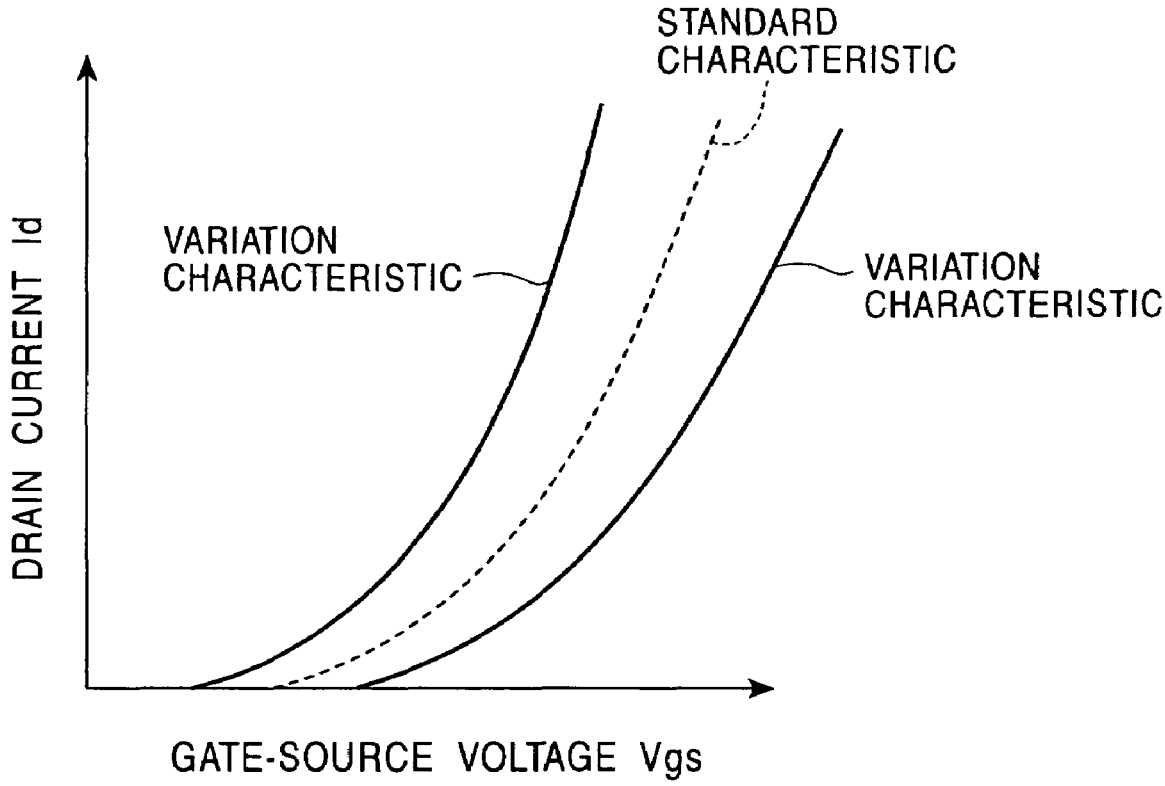
FIG. 4 shows changes in the gate-source voltage/drain current characteristic.
Figure 5A:
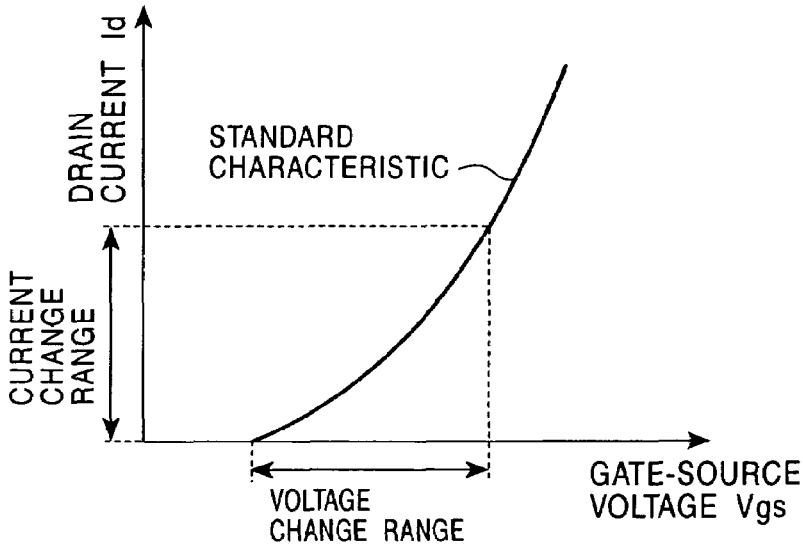
FIGS. 5A to 5C each show a relationship between a drain current change range and a change range for the gate-source voltage.
Figure 5B:
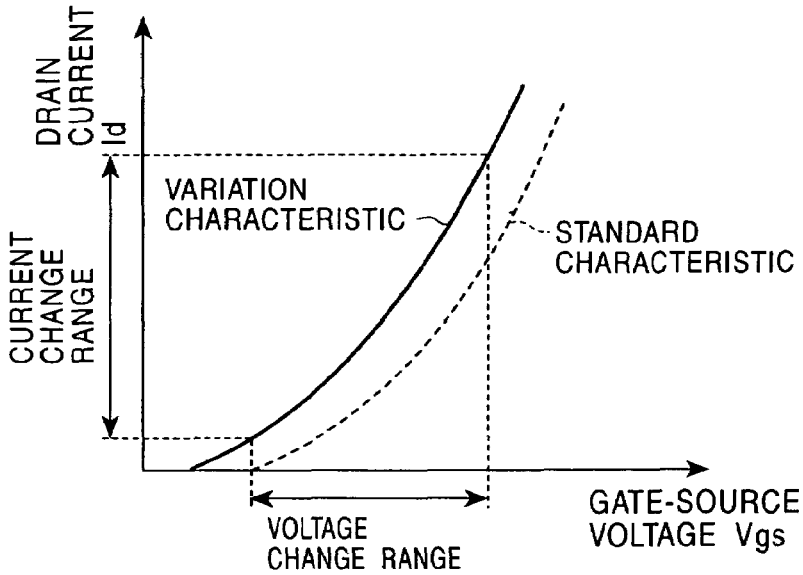
Figure 5C:
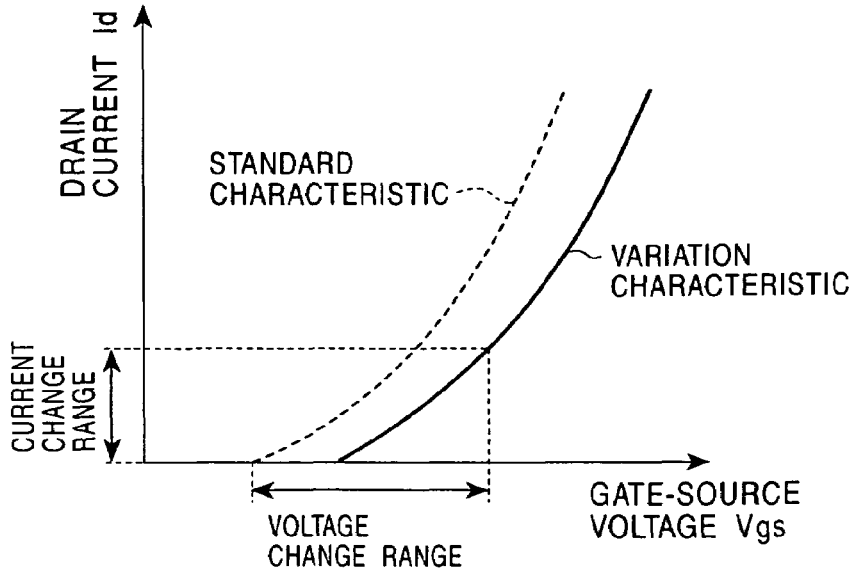
Figure 6:
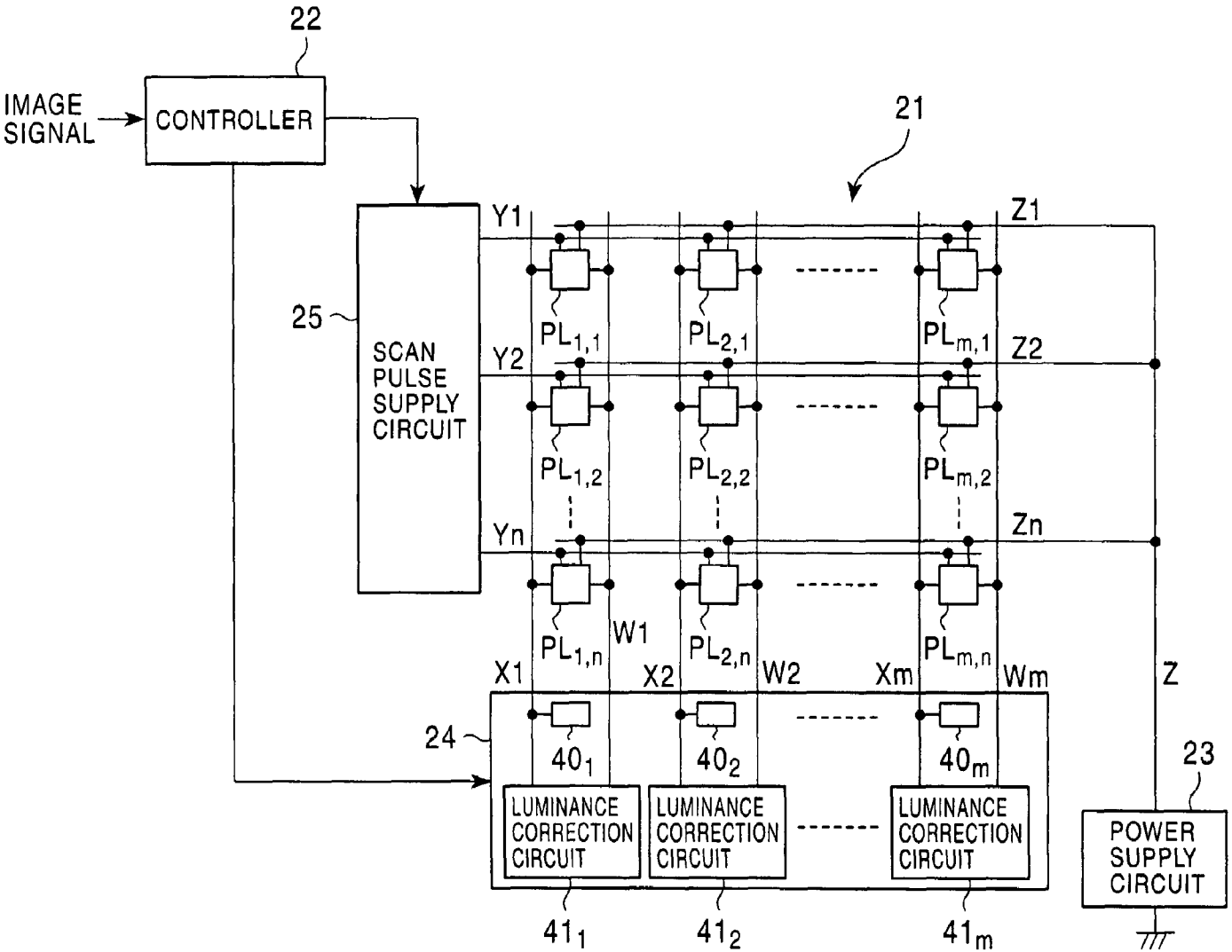
FIG. 6 is a block diagram showing the constitution of a display device to which the present invention is applied.

FIG. 6 shows an EL display device to which the present invention is applied. The display device comprises a display panel 21, a controller 22, a power supply circuit 23, a data signal supply circuit 24, and a scan pulse supply circuit 25.

The display panel 21 includes a plurality of data lines X1 to Xm which are disposed in parallel (where m is an integer of two or more), a plurality of scan lines Y1 to Yn (where n is an integer of two or more), and a plurality of power supply lines Z1 to Zn. The display panel 21 further includes a plurality of measurement lines W1 to Wm.

The plurality of data lines X1 to Xm and the plurality of measurement lines W1 to Wm are disposed in parallel as shown in FIG. 6. Likewise, the plurality of scan lines Y1 to Yn and the plurality of power supply lines Z1 to Zn are disposed in parallel as shown in FIG. 6. The plurality of data lines X1 to Xm and the plurality of measurement lines W1 to Wm mutually intersect with the plurality of scan lines Y1 to Yn and the plurality of power supply lines Z1 to Zn. Pixel sections $PL_{1.1}$ to $PL_{m.n}$ are disposed at the intersection positions between these lines so as to form a matrix display panel. The power supply lines Z1 to Zn are connected to one another to form one anode power supply line Z. The power supply line Z is supplied with a drive voltage VA which is a power voltage from the power supply circuit 23. Although not illustrated, the display panel 21 is provided with a cathode power supply line, that is, a ground line, in addition to the anode power supply lines Z1 to Zn and Z.

Figure 7:
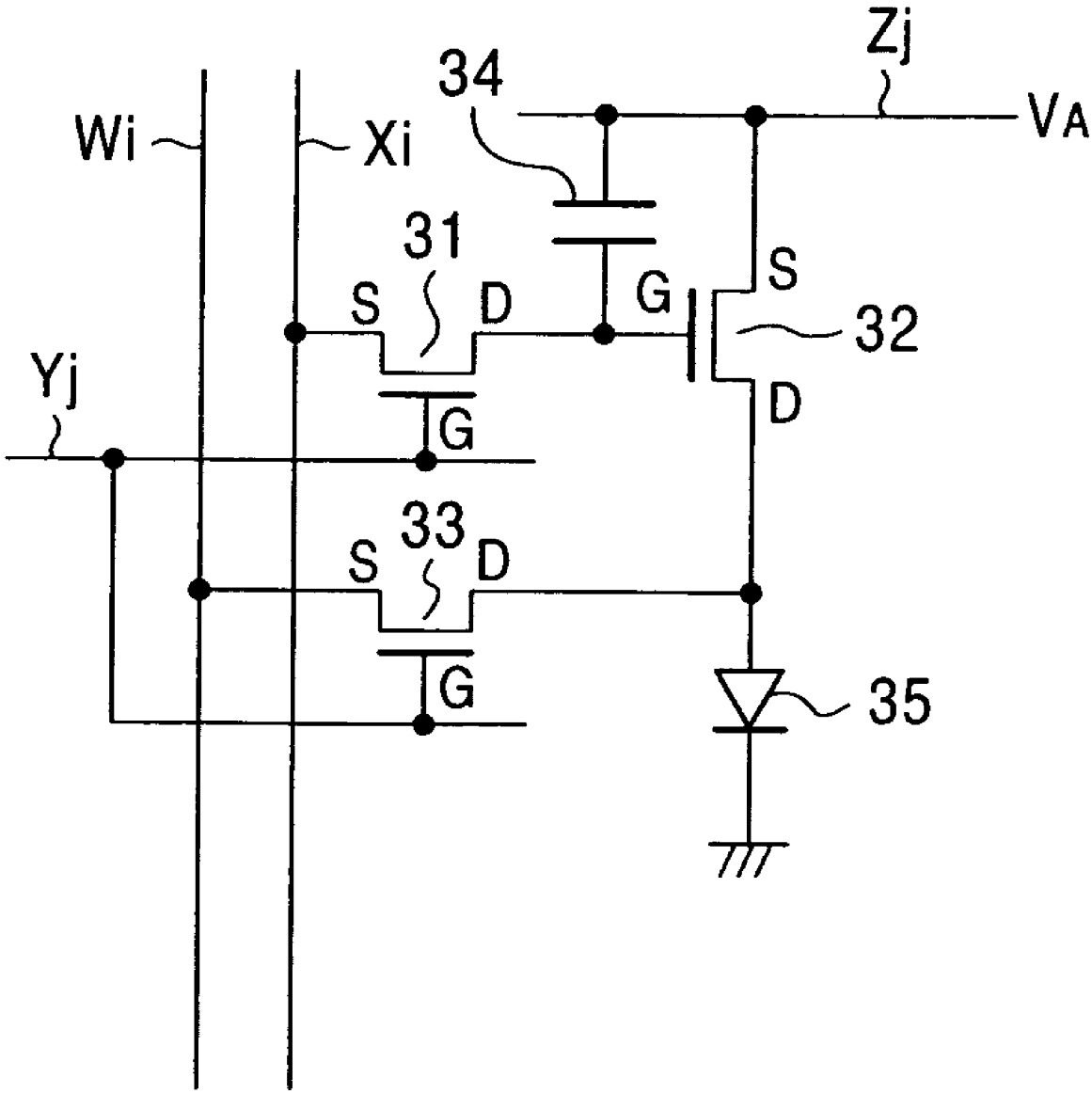
FIG. 7 is a circuit diagram showing the constitution of a pixel section in the device of FIG. 6.

Each of the plurality of pixel sections $PL_{1.1}$ to $PL_{m.n}$ has have the same constitution, namely three FETs 31 to 33, a capacitor 34, and an organic EL element 35, as shown in FIG. 7. The pixel section shown in FIG. 7 is one pixel section $PL_{i,j}$ of pixel sections $PL_{1.1}$ to $PL_{m.n}$, a data line is Xi, a measurement line is Wi, a scan line is Yj, and a power supply line is Zj. The gate of the FET 31 is connected to the scan line Yj, and the source of the FET 31 is connected to the data line Xi. One terminal of the capacitor 34 and the gate of the FET 32 are connected to the drain of the FET 31. The other terminal of the capacitor 34 and the source of the FET 32 are connected to the power supply line Zj. The drain of the FET 32 is connected to the anode of the EL element 35. The cathode of the EL element 35 is connected to the ground.

The gate of the FET 33 is connected to the above-mentioned scan line Yj and gate of the FET 31, while the source of the FET 33 is connected to the measurement line Wi. The drain of the FET 33 is connected to the anode of the EL element 35.

When a scan pulse is supplied to the gate of the FET 33 such that the FET 33 turns on, the anode voltage of the EL element 35 appears at the measurement line Wi through the drain and source of the FET 33. The anode voltage of the EL element 35 can therefore be measured easily outside the display panel 21.

The display panel 21 is connected to the scan pulse supply circuit 25 through the scan lines Y1 to Yn, and is connected to the data signal supply circuit 24 through the data lines X1 to Xm and the measurement lines W1 to Wm. The controller 22 generates a scan control signal and a data control signal in order to control gray levels of the display panel 21 in accordance with an input image signal. The scan control signal is supplied to the scan pulse supply circuit 25, and the data control signal is supplied to the data signal supply circuit 24.

The scan pulse supply circuit 25 is connected to the scan lines Y1 to Yn and, in response to the scan control signal, supplies a scan pulse to the scan lines Y1 to Yn in a predetermined order and with predetermined timing. A period during which one scan pulse is generated is one scanning period.

The data signal supply circuit 24 is connected to the data lines X1 to Xm and the measurement lines W1 to Wm, and generates a pixel data pulse for m pixel sections positioned on one scan line which is supplied with a scan pulse in accordance with the data control signal. The pixel data pulse is a data signal indicating a light emission luminance level and is stored in m buffer memories $\mathbf{40}_1$ to $\mathbf{40}_m$ in the data signal supply circuit 24. The data signal supply circuit 24 supplies the pixel data pulse from at least one of the buffer memories $\mathbf{40}_1$ to $\mathbf{40}_m$ to at least one pixel section which is to be driven to emit light, through corresponding data line(s) X1 to Xm. A pixel data pulse which is of a level such that an EL element is not caused to emit light is supplied to non-emitting pixel sections.

The data signal supply circuit 24 includes m luminance correction circuits $\mathbf{41}_1$ to $\mathbf{41}_m$ which are connected to the data lines X1 to Xm and the measurement lines W1 to Wm, respectively.

Figure 8:
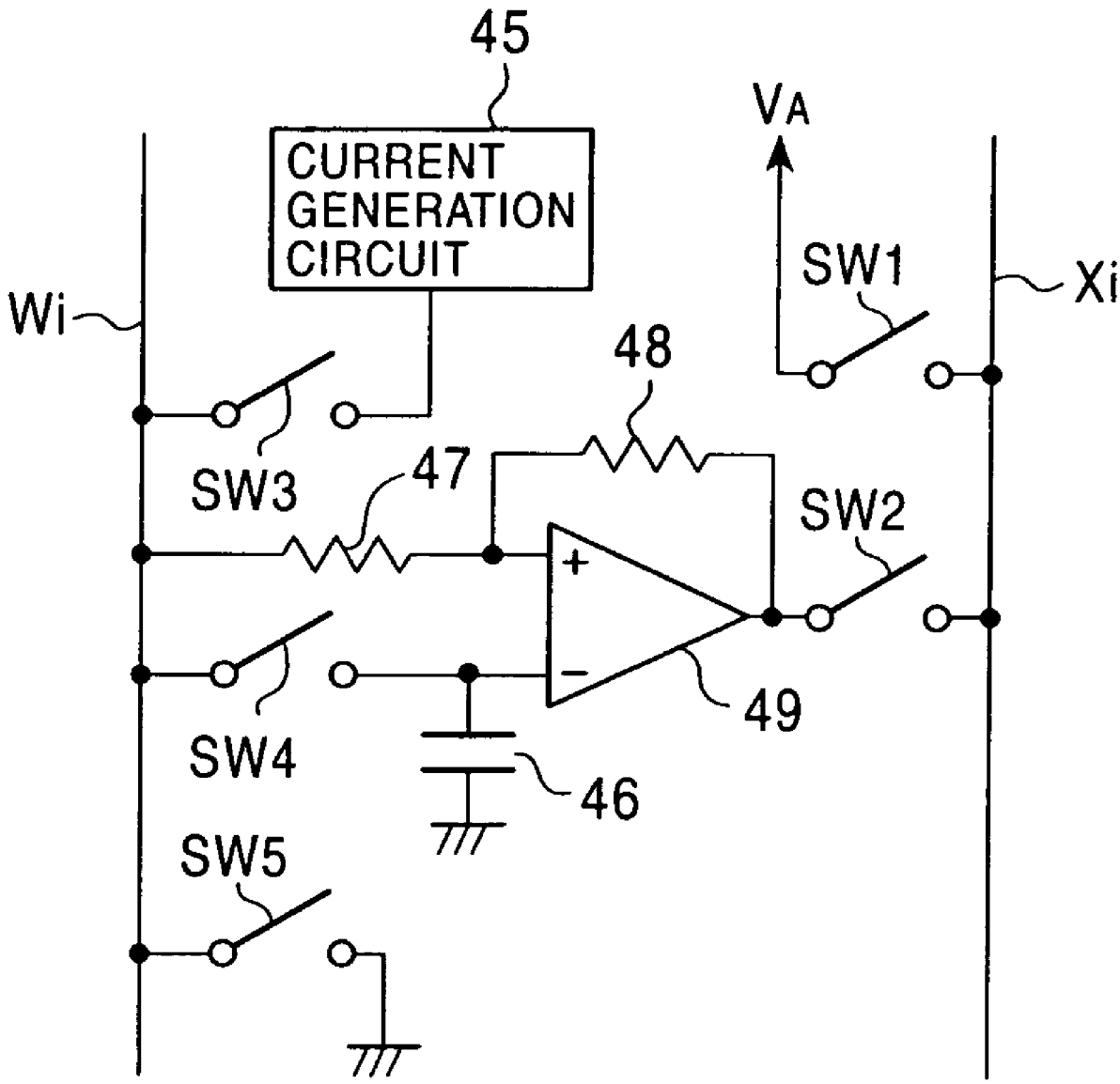
FIG. 8 shows a luminance correction circuit in the device in FIG. 6.

The luminance correction circuits $\mathbf{41}_1$ to $\mathbf{41}_m$ have the same constitution, and, as shown in FIG. 8, includes switch elements SW1 to SW5, a current generation circuit 45, a capacitor 46, resistors 47 and 48, and a differential amplifier 49. As in the pixel section in FIG. 7, in the circuit shown in FIG. 8, the lines relating this circuit are such that the data line is Xi, and the measurement line is Wi.

The above-mentioned drive voltage VA is supplied to the data line Xi through the switch element SW1. The measurement line Wi is connected to the ground through the switch element SW5. The current generation circuit 45 is connected to the measurement line Wi through the switch element SW3. The non-inverting input terminal of the differential amplifier 49 is connected to the measurement line Wi through the resistor 47, while the inverting input terminal is connected to the measurement line Wi through the switch element SW4 and is connected to the ground through the capacitor 46. Further, the resistor 48 is connected between the non-inverting input terminal and the output terminal of the differential amplifier 49, the output terminal being connected to the data line Xi through the switch element SW2.

On/off states of the switch elements SW1 to SW5 are controlled in accordance with instructions from the controller 22. The current generation circuit 45 outputs a current of a predetermined value. The predetermined value is set in accordance with the light emission luminance of the organic EL element 35. In other words, when the EL element is caused to emit light of a fixed luminance, the predetermined value is a fixed value. However, when the light emission luminance is caused to change in accordance with the data signal level, the predetermined value is a value that corresponds to the light emission luminance changed.

Figure 9:
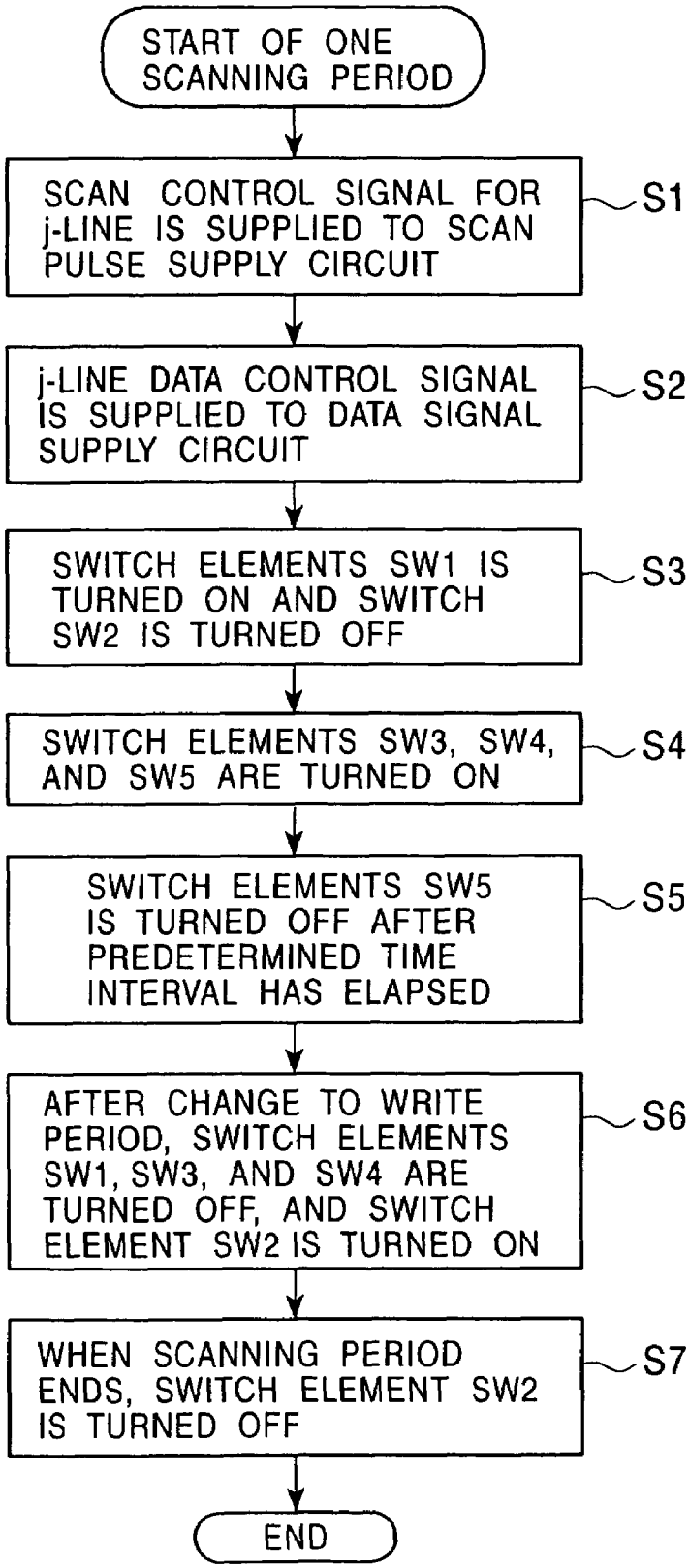
FIG. 9 is a flowchart showing the operation of a controller during a scanning period.
Figure 10:
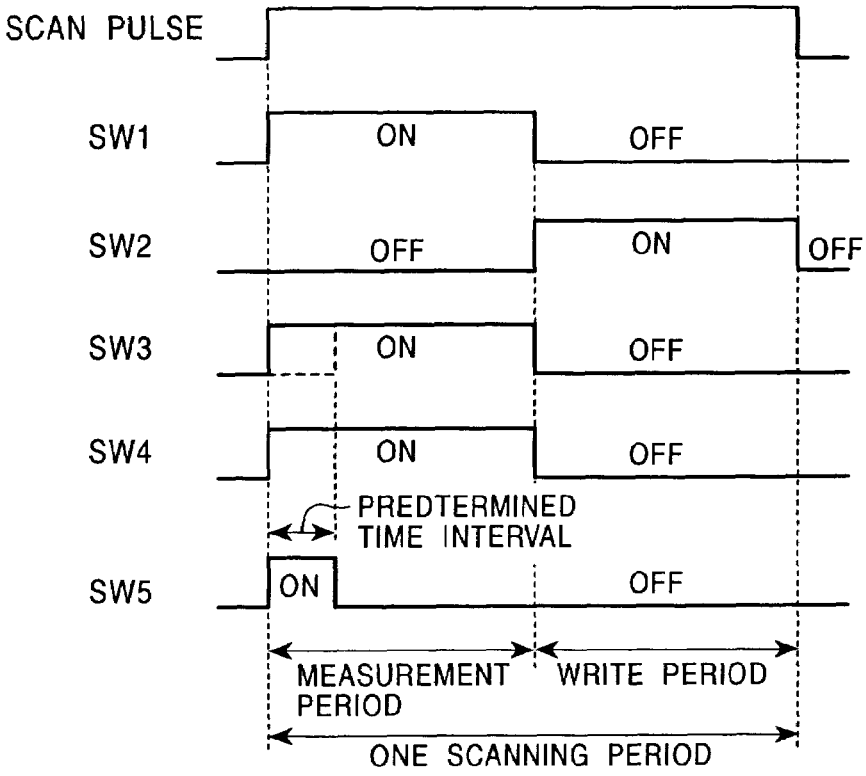
FIG. 10 shows a scan pulse and on/off states of switch elements in the luminance correction circuit.

Descriptions will be provided next for the operation of the circuits in FIGS. 7 and 8 with reference to FIGS. 9 and 10. Here, the operation when the j-line (scan line Yj) is scanned to cause the EL element 35 to emit light will be described for the display panel 21 in particular.

As shown in FIG. 9, the controller 22 supplies a scan control signal for the j-line to the scan pulse supply circuit 25 in response to an image signal (step S1), and supplies a j-line data control signal to the data signal supply circuit 24 (step S2). A scan pulse is thus supplied from the scan pulse supply circuit 25 to the scan line Yj, and A pixel data pulse is stored in the buffer memory ($\mathbf{40}_i$ (not illustrated) of $\mathbf{40}_1$ to $\mathbf{40}_m$) in the data signal supply circuit 24, the pulse then being supplied to the current generation circuit 45. As shown in FIG. 10, the scan pulse indicates a high level during one scanning period. The one scanning period is divided into two periods, namely a measurement period and a write period. The pixel data pulse has a pulse voltage which corresponds to a drive current flowing in the EL element 35.

On the other hand, since the scan pulse is supplied to the respective gates of the FETs 31 and 33, the FETs 31 and 33 are then on.

The controller 22 turns the switch element SW1 on and the switch element SW2 off (step S3) immediately after executing step S2. The drive voltage VA is applied to the data line Xi as a result of the on state of the switch element SW1 and the off state of the switch element SW2. Since the drive voltage VA is applied from the data line Xi to the gate of the FET 32 through the source and drain of the FET 31, the source voltage and the gate voltage of the FET 32 are equal to each other and then the FET 32 is off. A voltage whereby the FET 32 is turned off could also be used in place of the drive voltage VA.

The controller 22 also turns on the switch elements SW3, SW4, and SW5 (step S4). The measurement line Wi is at the ground potential as a result of the switch element SW5 being on. Further, the stored charge of the capacitor 46 is discharged to the ground as a result of the switch element SW4 being on. Since the anode of the EL element 35 is made equal to the ground potential through the medium of the FET 33, the stored charge of the EL element 35 is also discharged.

The controller 22 turns the switch element SW5 off (step S5) after a predetermined time interval has elapsed following the execution of step S4. At such time, the switch elements SW3 and SW4 remain on. As a result of the off state of the switch element SW5, a current of a predetermined value flows from the current generation circuit 45 to the EL element 35 through the switch element SW3, the measurement line Wi and the source and drain of the FET 33. The EL element 35 emits light as a result of the current. Furthermore, the current from the current generation circuit 45 flows into the capacitor 46 through the switch element SW3, the measurement line Wi, and the switch element SW4. A voltage Vf that is substantially equal to the anode voltage of the EL element 35 is generated in the measurement line Wi. Thus, the capacitor 46 then stores the anode voltage Vf of the EL element 35. The voltage Vf stored in the capacitor 46 is therefore the anode voltage of the EL element 35 when a current of a predetermined value flows through the EL element 35.

These steps S1 to S5 are executed within the measurement period. When the transition is made from the measurement period to the write period, the controller 22 turns off the switch elements SW1, SW3, and SW4, and turns on the switch element SW2 (step S6). As a result of the off state of the switch element SW1 and the on state of the switch element SW2, the output terminal of the differential amplifier 49 is electrically connected to the data line Xi through the switch element SW2.

The pixel data pulse is applied to the gate of the FET 32 and to the capacitor 34 through the data line Xi and the source and drain of the FET 31, and, as a result of the on state of the FET 32, the drive current flows to the EL element 35 through the source and drain of the FET 32. The EL element 35 accordingly emits light. Further, the capacitor 34 is charged to a charge voltage that is dependent on the voltage of the pixel data pulse.

As a result of the off states of the switch elements SW3 and SW4, the anode voltage during light emission by the EL element 35 is detected in the measurement line Wi through the FET 33, and is supplied to the non-inverting input terminal of the differential amplifier 49 through the resistor 47. The differential amplifier 49 operates such that the voltage of the non-inverting input terminal thereof, that is, the anode voltage of the EL element 35, is made equal to the stored voltage Vf in the capacitor 46 which is supplied to the inverting input terminal. In cases where the anode voltage of the EL element 35 is lower than the stored voltage Vf, the output voltage of the differential amplifier 49 increases, and therefore the output voltage acts on the capacitor 34 and the gate of the FET 32 through the source and drain of the FET 31. Thus, the charge voltage of the capacitor 34, that is, the gate voltage Vg of the FET 32, is corrected by being increased. As a result, the drive current flowing in the EL element 35 increases and the light emission luminance of the EL element 35 which is preset at the voltage level of the pixel data pulse at such time is obtained.

When the write period, that is, the j-line scanning period ends, the scan pulse supply circuit 25 stops generating the scan pulse supplied to the scan line Yj, and the FETs 31 and 33 therefore turn off. The data signal supply circuit 24 resets the storage of the pixel data pulse supplied to the data line Xi. Further, the controller 22 turns off the switch element SW2 (step S7). Since the charge voltage Vg of the capacitor 34 is maintained, the FET 32 remains on and the EL element 35 continues to emit light. When the charge voltage Vg of the capacitor 34 is corrected by being increased as described above, the charge voltage Vg of the capacitor 34 is held at the corrected voltage. Thus, the light emission luminance of the EL element 35 is also maintained at the luminance immediately before the end of the write period. The pixel sections on the j-line then enter a hold period until the start of the next scanning period.

When the j-line scanning period ends, the controller 22 moves on to the operation for the following scanning period for the line j+1. Once the scanning period amounting to n lines ends, the controller 22 moves on to the operation for a single line scanning period. The operation in each of the scanning periods is the same as the operation indicated by steps S1 to S7 above, these steps S1 to S7 being executed for each scanning period.

Further, in the above embodiment, the switch element SW3 is also on in the on period (predetermined period) of the switch element SW5. However, the switch element SW3 could also be off during this period, as indicated by the broken line in FIG. 10. In other words, the switch element SW3 could also be turned on at the same time switch element SW5 changes from on to off.

Further, the stored charge of the EL element may be discharged by turning on the switch element SW5 for only a short interval at the time the switch is made from the measurement period to the write period.

Figure 11:
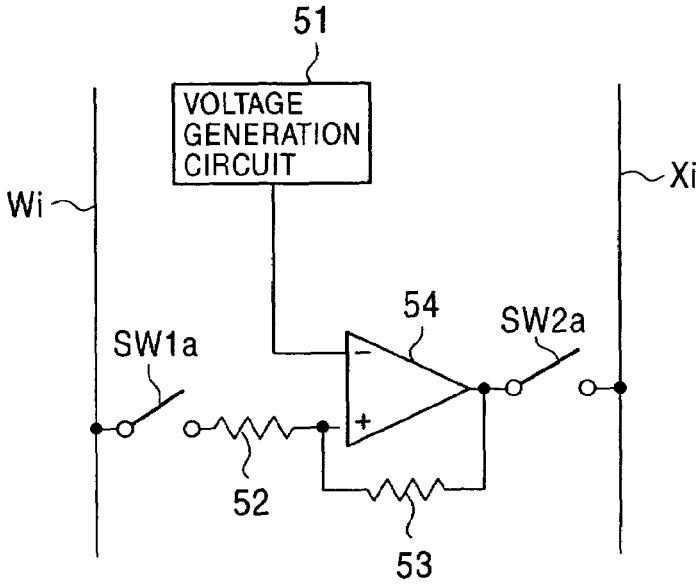
FIG. 11 shows another constitution for the luminance correction circuits in the device in FIG. 6.

FIG. 11 shows another constitution of each of the luminance correction circuits $\mathbf{41}_1$ to $\mathbf{41}_m$. The luminance correction circuit in FIG. 11 includes switch elements SW1*a*, SW2*a*, a voltage generation circuit 51, resistors 52 and 53, and a differential amplifier 54. In the circuit shown in FIG. 11, the data line Xi and the measurement line Wi are used to illustrate the connection with the pixel section in FIG. 7.

The voltage generation circuit 51 generates a voltage Vf which is equal to the anode voltage when the EL element 35 emits light at a luminance corresponding to the level of the pixel data pulse. If the level of the pixel data pulse varies in accordance with to the image signal, the output voltage Vf of the voltage generation circuit 51 varies accordingly. The output voltage Vf of the voltage generation circuit 51 is supplied to the inverting input terminal of the differential amplifier 54. The non-inverting input terminal of the differential amplifier 54 is serially connected to the measurement line Wi through the resistor 52 and the switch element SW1*a*. Further, the resistor 53 is connected between the non-inverting input terminal and the output terminal of the differential amplifier 49, this output terminal being connected to the data line Xi through the switch element SW2*a*. The on/off operations of the switch elements SW1*a* and SW2*a* are controlled in accordance with instructions from the controller 22.

Figure 12:
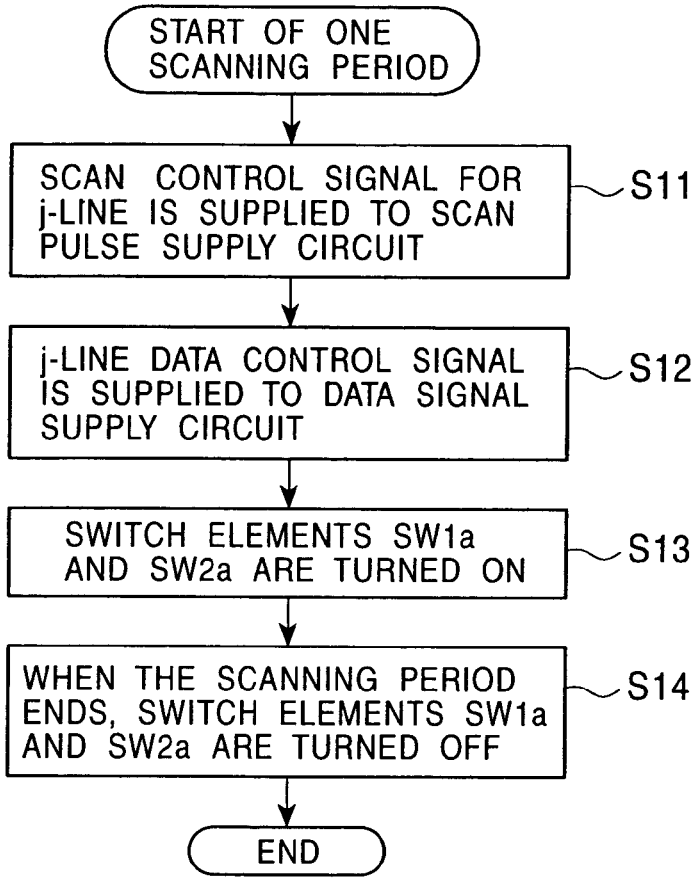
FIG. 12 is a flowchart showing the operation of a controller during the scanning period when the luminance correction circuit of FIG. 11 is used.
Figure 13:
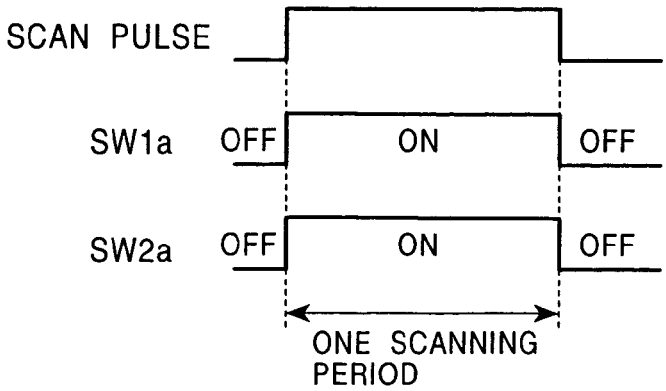
FIG. 13 shows a scan pulse and on/off states of switch elements of the luminance correction circuit of FIG. 11.

A description will be provided next for the operation when the luminance correction circuits of FIG. 11 are applied, with reference to FIGS. 12 and 13. Here, the operation when the EL element 35 is caused to emit light by scanning the j-line (scan line Yj) will be described for the display panel 21 in particular.

As shown in FIG. 12, the controller 22 supplies a scan control signal for the j-line to the scan pulse supply circuit 25 in response to an image signal (step S11), and supplies a j-line data control signal to the data signal supply circuit 24 (step S12). A scan pulse is accordingly supplied from the scan pulse supply circuit 25 to the scan line Yj, and a pixel data pulse is stored in the above-mentioned buffer memory $\mathbf{40}_i$ in the data signal supply circuit 24 and then supplied to the voltage generation circuit 51. As shown in FIG. 13, the scan pulse is a high level during one scanning period. The pixel data pulse has a pulse voltage which corresponds to a drive current flowing in the EL element 35.

Meanwhile, the scan pulse is supplied to the respective gates of the FETs 31 and 33 such that the FETs 31 and 33 turn on. The pixel data pulse is applied to the gate of the FET 32 and to the capacitor 34 through the data line Xi and the source and drain of the FET 31. As a result of the FET 32 turning on, the drive current flows to the EL element 35 through the source and drain of the FET 32. The EL element 35 accordingly emits light. Further, the capacitor 34 is charged to a charge voltage that is dependent on the voltage of the pixel data pulse.

The controller 22 also turns on both of the switch elements SW1*a* and SW2*a* (step S13). As a result of the on states of the switch elements SW1*a* and SW2*a*, the anode voltage during light emission by the EL element 35 is detected in the measurement line Wi through the FET 33, and is supplied to the non-inverting input terminal of the differential amplifier 54 through the switch element SW1*a* and the resistor 52. The differential amplifier 54 operates such that this anode voltage is made equal to the voltage of the inverting input terminal, that is, the voltage Vf supplied by the voltage generation circuit 51. As a result of the off states of the switch elements SW3 and SW4, the anode voltage during light emission by the EL element 35 is detected in the measurement line Wi through the FET 33, and is supplied to the non-inverting input terminal of the differential amplifier 49 through the resistor 47. The differential amplifier 49 operates such that the voltage of the non-inverting input terminal thereof, that is, the anode voltage of the EL element 35, is made equal to the stored voltage Vf in the capacitor 46 which is supplied to the inverting input terminal. When the anode voltage of the EL element 35 is lower than the stored voltage Vf, the output voltage of the differential amplifier 54 increases. Therefore, the output voltage acts at capacitor 34 and the gate of the FET 32 through the source and drain of the FET 31. The charge voltage of the capacitor 34, that is, the gate voltage Vg of the FET 32, is corrected by being increased. As a result, the drive current flowing in the EL element 35 increases and the light emission luminance of the EL element 35 which is preset at the voltage level of the pixel data pulse at such time is obtained.

When the write period, that is, the j-line scanning period ends, the scan pulse supply circuit 25 stops generating the scan pulse supplied to the scan line Yj, and the FETs 31 and 33 therefore turn off. The data signal supply circuit 24 resets the storage of the pixel data pulse supplied to the data line Xi. Further, the controller 22 turns off the switch elements SW1*a* and SW2*a* (step S14). The charge voltage Vg of the capacitor 34 is maintained, and thus the FET 32 remains on and the EL element 35 continues to emit light. When the charge voltage Vg of the capacitor 34 is corrected by being increased as described above, the charge voltage Vg of the capacitor 34 is held at the corrected voltage. Thus, the light emission luminance of the EL element 35 is also maintained at the luminance immediately before the end of the scanning period. The pixel sections on the j-line then enter a hold period until the start of the next scanning period.

When the j-line scanning period ends, the controller 22 moves on to the operation for the following scanning period for the line j+1. Once the scanning period amounting to n lines ends, the controller 22 moves on to the operation for a single line scanning period. The operation in each of the scanning periods is the same as the operation indicated by steps S11 to S14 above, these steps S11 to S14 being executed for each scanning period.

Therefore, according the embodiments described above, even if the internal resistance values of the EL elements vary in accordance with manufacturing inconsistencies, changes in the ambient temperature or according to the cumulative light emission time and so forth, the luminance level of the whole screen of the display panel 21 can be continuously maintained within the desired luminance range.

Further, the embodiments described above show a display device that employs organic EL elements as light emitting elements. However, the light emitting elements are not limited to such organic EL elements, and the present invention may also be applied to display devices that employ other light emitting elements.

As described hereinabove, according to the present invention, a gray level display can be correctly implemented even when used for a long period.

This application is based on Japanese Patent Applications No. 2002-201696 which is hereby incorporated by reference.

What is claimed is:

1. An active type display panel comprising a plurality of data lines, a plurality of scan lines mutually intersecting said plurality of data lines, a plurality of pixel sections which are formed at respective intersection points of the data lines and the scan lines and each include a series circuit in which a light emitting element and a drive element which supplies a drive current to said light emitting element are connected in series, and a pair of power supply lines which connect the series circuits of said plurality of pixel sections in parallel;

wherein each of said plurality of pixel sections further comprises a switch element of which one end is connected to a point connecting said light emitting element and said drive element, and a pixel controller which activates said drive element in accordance with an input signal on a corresponding data line during a scanning period to supply a drive current of a level corresponding to the input signal to said light emitting element, and wherein said display panel further comprises for each of the data lines:

a switching portion which supplies a reference current to the light emitting element through said switch element during a first time period of the scanning period and halts the supply of said reference current in a second time period which remains in the scanning period to permit the activation of the drive element;

a holding portion which holds a voltage across the terminals of said light emitting element through said switch element during said first time period;

a comparator which generates, during the second time period, a correction voltage corresponding to the difference between the voltage held in the holding portion and the voltage across the terminals of said light emitting element;

and an outputting portion which supplies the correction voltage to the corresponding data line during said second time period.

2. A display panel according to claim 1 further comprises a plurality of measurement lines of which the number is equal to the number of said data lines, wherein said drive element is a first field effect transistor of which the source is connected to one line of the pair of power supply lines, wherein said pixel controller comprises:

a second field effect transistor, of which the gate is connected to one scan line of said plurality of scan lines, the source is connected to one data line of said plurality of data lines, and the drain is connected to the gate of said first field effect transistor; and a capacitor connected between one line of the pair of power supply lines, and a line connecting the gate of said first field effect transistor and the drain of said second field effect transistor, wherein said light emitting element is an organic electroluminescence element of which the anode is connected to the drain of said first field effect transistor and the cathode is connected to the other line of the pair of power supply lines; and wherein said switch element is a third field effect transistor of which the gate is connected to the one scan line, the source is connected to one measurement line of said plurality of measurement lines to supply a reference current to the light emitting element by said switching portion and to provide the voltage across the terminals of said light emitting element to said holding portion and said comparator, and the drain is connected to a line connecting the drain of said first field effect transistor and the anode of said organic electroluminescence element.

3. A display device comprising:

an active type display panel comprising a plurality of data lines, a plurality of scan lines mutually intersecting said plurality of data lines, and a plurality of pixel sections each including a series circuit in which a light emitting element and a drive element which supplies a drive current to said light emitting element are connected in series, and which is connected between one of said plurality of data lines and one of said plurality of scan lines at an intersection thereof;

a power voltage supply portion which applies a power voltage to said series circuit of each of said pixel sections; and a display controller which designates one scan line of said plurality of scan lines sequentially with predetermined timing in accordance with an input image signal, supplies a scan pulse to the designated one scan line, and supplies a data signal indicating light emission luminance to at least one data line of said plurality of data lines in a scanning period during which the scan pulse is supplied, the at least one data line corresponding to at least one light emitting element to be emitted light on the designated one scan line, wherein each of said plurality of pixel sections includes a switch element of which one end is connected to a point connecting said light emitting element and said drive element, and a pixel controller which activates said drive element response to the data signal on a corresponding data line during a scanning period to supply a drive current of a level corresponding to the data signal to said light emitting element, wherein said display panel further comprises for each of a plurality of data lines:

a switching portion supplies a reference current to the light emitting element through said switch element during a first time period in the scanning period and halts the supply of said reference current in a second time period in the scanning period to permit the activation of the drive element;

a holding portion which holds a voltage across the terminals of said light emitting element through said switch element during said first time period;

a comparator which generates, during the second time period, a correction voltage corresponding to the difference between the voltage held in the holding portion and the voltage across the terminals of said light emitting element; and an outputting portion which supplies the correction voltage to the corresponding data line during said second time period.

4. A display device according to claim 3, wherein said display panel further comprises a plurality of measurement lines, wherein said drive element consists of a first field effect transistor of which the source is connected to the positive output terminal of said power voltage supply portion, and wherein said pixel controller comprises:

a second field effect transistor of which the gate is connected to the scan line for a corresponding column of said plurality of scan lines, the source is connected to the data line for a corresponding row of said plurality of data lines, and the drain is connected to the gate of said first field effect transistor;

a first capacitor connected between the positive output terminal of said power voltage supply portion, and a line connecting the gate of said first field effect transistor and the drain of said second field effect transistor;

an organic electroluminescence element which is provided as said light emitting element and of which the anode is connected to the drain of said first field effect transistor and the cathode is connected to the negative output terminal of said power voltage supply portion; and a third field effect transistor which is provided as said voltage detector and of which the gate is connected to the scan line for the corresponding column, the source is connected to the measurement line for the corresponding row of said plurality of measurement lines, and the drain is connected to a line connecting the drain of said first field effect transistor and the anode of said organic electroluminescence element, wherein the voltage across the terminals of said light emitting element is supplied to said data correction portion as an anode voltage of said organic electroluminescence element through the drain and source of said third field effect transistor and the measurement line for the corresponding row, and wherein each of said pixel sections includes a current generation circuit for generating a reference current of a level corresponding to the data signal; and wherein said switching portion halts activation of said drive element by said pixel controller by supplying the reference current in the first time period appearing first in the scanning period during which the scan pulse is supplied, to said organic electroluminescence element through the measurement line for the corresponding row and through the source and drain of said third field effect transistor, and for permitting activation of said drive element by said pixel controller by halting the supply of the reference current to said organic electroluminescence element in the second time period which remains in the scanning period.

5. A display device according to claim 4, wherein said display panel further comprises for each of a plurality of data lines another switching portion which supplies a voltage required for halting activation of said drive element by said pixel controller, to the source of said second field effect transistor during the first time period.

6. A display device according to claim 5, where the voltage required for halting the activation of said drive element is a voltage equal to the power voltage.

7. A driving method for an active type display panel comprising a plurality of data lines, a plurality of scan lines mutually intersecting said plurality of data lines, and a plurality of pixel sections each including a series circuit in which a light emitting element and a drive element for supplying a drive current to said light emitting element are connected in series, and which is connected between one of said plurality of data lines and one of said plurality of scan lines at an intersection thereof; comprising the steps of:

applying a power voltage to said series circuit of each of said pixel sections;

designating one scan line of said plurality of scan lines sequentially with predetermined timing in accordance with an input image signal, supplying a scan pulse to the designated one scan line, and supplying a data signal indicating light emission luminance to at least one data line of said plurality of data lines in a scanning period during which the scan pulse is supplied, the at least one data line corresponding to at least one light emitting element to be emitted light on the designated one scan line;

wherein said driving method further comprises the steps of in each of said pixel sections:

supplying a reference current to the light emitting element through a switch element during a first time period in the scanning period and halting the supply of said reference current in a second time period in the scanning period to permit the activation of the drive element;

holding a voltage across the terminals of said light emitting element through said switch element during said first time period;

generating, during the second time period, a correction voltage corresponding to the difference between the voltage held in the holding step and the voltage across the terminals of said light emitting element; and supplying the correction voltage to the corresponding data line.

8. An active type display panel comprising a plurality of data lines, a plurality of scan lines mutually intersecting said plurality of data lines, a plurality of pixel sections which are formed at respective intersection points of the data lines and the scan lines and each include a series circuit in which a light emitting element and a drive element which supplies a drive current to said light emitting element are connected in series, a pair of power supply lines which connect the series circuits of said plurality of pixel sections in parallel, and a plurality of measurement lines;

wherein each of said plurality of pixel sections further comprises a switch element of which one end is connected to a point connecting said light emitting and said drive element and of which another end is connected to one measurement line of said plurality of measurement lines.

9. A display panel according to claim 8, wherein the number of said plurality of measurement lines is equal to the number of said data lines, wherein said drive element is a first field effect transistor of which the source is connected to one line of the pair of power supply lines, wherein said display panel further comprises:

a second field effect transistor, of which the gate is connected to one scan line of said plurality of scan lines, the source is connected to one data line of said plurality of data lines, and the drain is connected to the gate of said first field effect transistor; and a capacitor connected between one line of the pair of power supply lines, and a line connecting the gate of said first field effect transistor and the drain of said second field effect transistor, wherein said light emitting element is an organic electroluminescence element of which the anode is connected to the drain of said first field effect transistor and the cathode is connected to the other line of the pair of power supply lines, and wherein said switch element is a third field effect transistor of which the gate is connected to the one scan line, the source is connected to the one measurement line and the drain is connected to a line connecting the drain of said first field effect transistor and the anode of said organic electroluminescence element.

* * * * *